US005120261A

United States Patent [19]

Dietzman

[11] Patent Number: 5,120,261

[45] Date of Patent: Jun. 9, 1992

[54] TOY NUNCHUK APPARATUS

[76] Inventor: Nancy L. Dietzman, 382 California Ave., Aurora, Ill. 60506

[21] Appl. No.: 714,921

[22] Filed: Jun. 13, 1991

[51] Int. Cl.[5] ..... A63H 33/30

[52] U.S. Cl. ..... 446/473; 446/486; 273/84 R; 482/83

[58] Field of Search ..... 446/473, 267, 486, 490; 272/76; 273/84 R

[56] References Cited

U.S. PATENT DOCUMENTS 4,631,770 12/1986 Goldberg ..... 273/84 R X
4,682,774 7/1987 Holy ..... 273/84 R
4,949,966 8/1990 Bopp ..... 273/84 R X

FOREIGN PATENT DOCUMENTS 829062 2/1960 United Kingdom ..... 446/473
2125302 3/1984 United Kingdom ..... 272/76

*Primary Examiner*—Mickey Yu
*Attorney, Agent, or Firm*—Leon Gilden

[57] ABSTRACT

A toy apparatus including a plurality of spaced handle members, each handle member including a central support rod surrounded by a polymeric foam exterior cylindrical member secured together by frangible link members defining a chain, wherein the link members are of a flexible material separable to prevent inadvertent injury during use of the toy apparatus. The organization includes in a modified organization the use of a mounted simulated knife member, wherein the simulated knife member includes an interior reservoir and a valve member mounted at a forward end of the knife member to permit imparting of a fluid upon striking an opponent with the valve mounted at a forward end of the knife member.

6 Claims, 5 Drawing Sheets

10
12
13
13
11
11

TOY NUNCHUK APPARATUS

BACKGROUND OF THE INVENTION

1. Field of the Invention

The field of invention relates to toy simulation weaponry, and more particularly pertains to a new and improved toy nunchuk apparatus wherein the same is arranged for use in simulation of martial arts interplay between children.

2. Description of the Prior Art

Various devices have been utilized with safeguards for use by children and the like for use in contact-type sporting arrangements. Such apparatus is exemplified in U.S. Pat. No. 4,382,966 wherein a club-like member includes a polymeric sheath thereabout.

U.S. Pat. No. 4,892,303 to Lohre sets forth a fencing device formed with a foam-surrounding sheath and interconnection of the handle and the sheath preventing inadvertent injury.

U.S. Pat. No. 3,972,526 to Cox, Jr. sets forth balloon members arranged for receiving a body of a child and the like therein to permit the children utilizing the balloon members to impact and bounce relative to one another.

U.S. Pat. No. 1,276,959 to Riebe sets forth a fencing implement formed with cushion absorbing head.

U.S. Pat. No. 4,095,294 to Winterbottom sets forth a boxing type arrangement utilizing a protective head gear and cushioned inflatable glove preventing injury.

As such, it may be appreciated that there continues to be a need for a now and improved toy nunchuk apparatus as set forth by the instant invention which addresses both the problems of ease of use as well as effectiveness in construction in providing an amusing and instructional implement for use by children in a martial arts scenario and in this respect, the present invention substantially fulfills this need.

SUMMARY OF THE INVENTION

In view of the foregoing disadvantages inherent in the known types of toy martial arts apparatus now present in the prior art, the present invention provides a toy nunchuk apparatus wherein the same utilizes a plurality of spaced padded handles interconnected by frangible link chain. As such, the general purpose of the present invention, which will be described subsequently in greater detail, is to provide a new and improved toy nunchuk apparatus which has all the advantages of the prior art toy martial arts apparatus and none of the disadvantages.

To attain this, the present invention provides a toy apparatus including a plurality of spaced handle members, each handle member including a central support rod surrounded by a polymeric foam exterior cylindrical member secured together by frangible link members defining a chain, wherein the link members are of a flexible material separable to prevent inadvertent injury during use of the toy apparatus. The organization includes in a modified organization the use of a mounted simulated knife member, wherein the simulated knife member includes an interior reservoir and a valve member mounted at a forward end of the knife member to permit imparting of a fluid upon striking an opponent with the valve mounted at a forward end of the knife member.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved toy nunchuk apparatus which has all the advantages of the prior art toy martial arts apparatus and none of the disadvantages.

It is another object of the present invention to provide a new and improved toy nunchuk apparatus which may be easily and efficiently manufactured and marketed.

It is a further object of the present invention to provide a new and improved toy nunchuk apparatus which is of a durable and reliable construction.

An even further object of the present invention is to provide a new and improved toy nunchuk apparatus which is susceptible of a low cost of manufacture with regard to both materials and labor, and which accordingly is then susceptible of low prices of sale to the consuming public, thereby making such toy nunchuk apparatus economically available to the buying public.

Still yet another object of the present invention is to provide a new and improved toy nunchuk apparatus which provides in the apparatuses and methods of the prior art some of the advantages thereof, while simultaneously overcoming some of the disadvantages normally associated therewith.

Still another object of the present invention is to provide a new and improved toy nunchuk apparatus wherein the same utilizes a plurality of safety features to prevent inadvertent injury during use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an orthographic cross-sectional configuration of one of the plurality of the plurality of handles utilized by the instant invention.

DESCRIPTION OF THE PREFERRED EMBODIMENT

Figure 1:
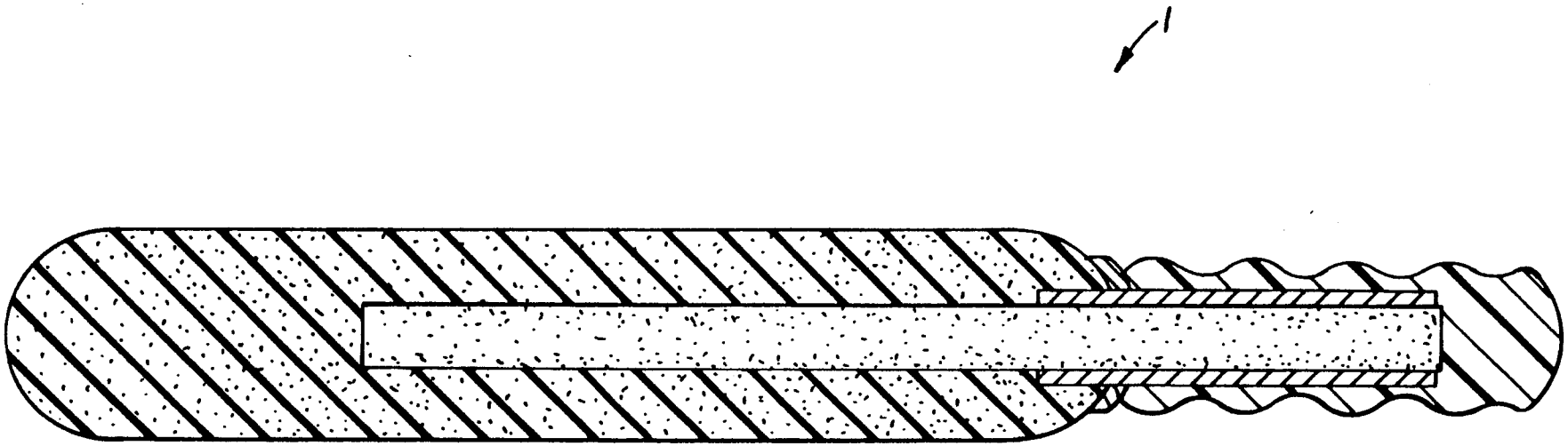
FIG. 1 PRIOR ART
FIG. 1 is an orthographic cross-sectional illustration of a prior art impact toy.
Figure 2:
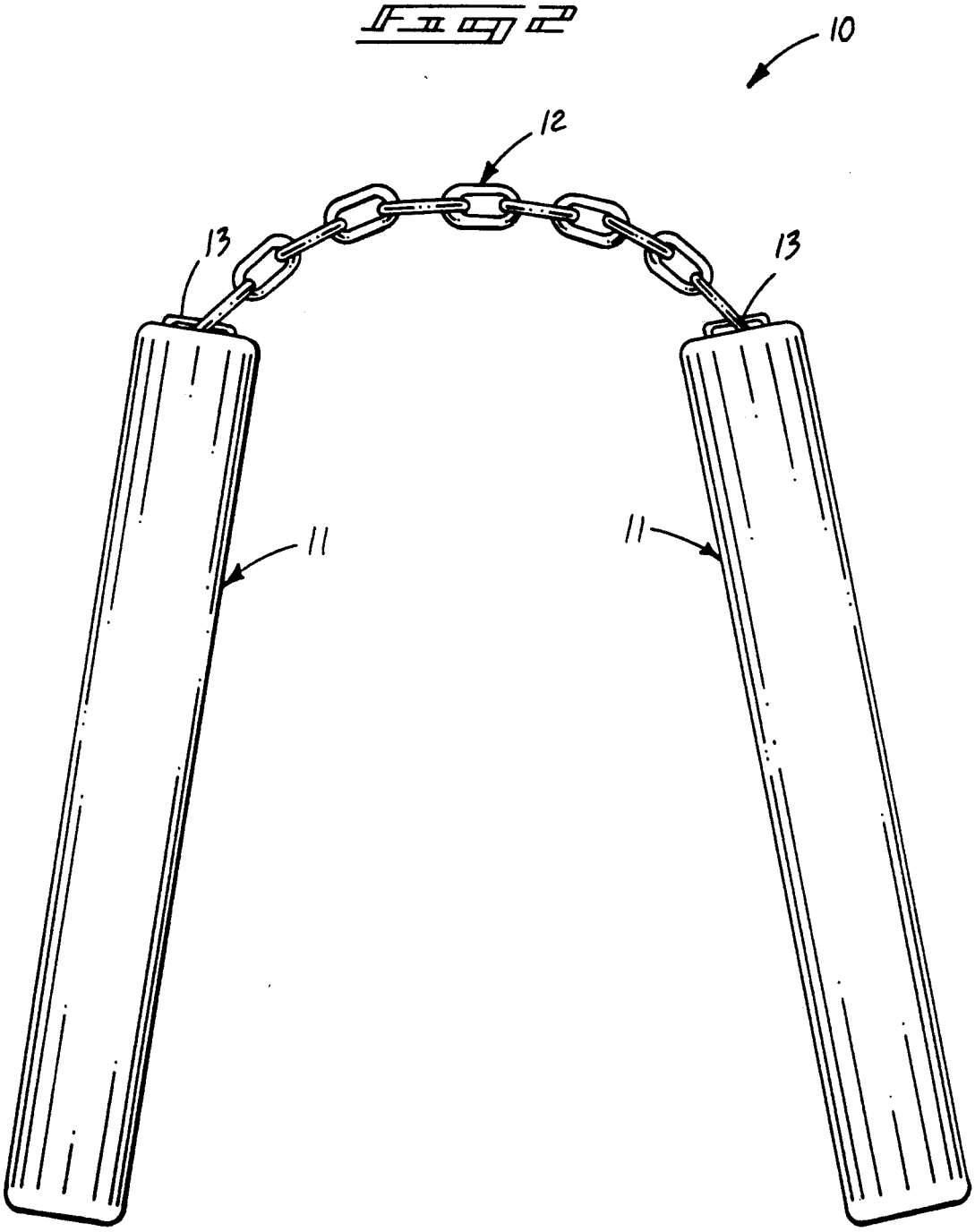
FIG. 2 is an orthographic top view of the instant invention.

With reference now to the drawings, and in particular to FIGS. 1 to 8 thereof, a new and improved toy nunchuk apparatus embodying the principles and concepts of the present invention and generally designated by the reference numerals 10 and 10*a* will be described.

FIG. 1 illustrates a prior art apparatus 1, as set forth in U.S. Pat. No. 4,328,966, utilizing a central core mounting a polymeric foam member thereabout mounting a handle thereto.

More specifically, the toy nunchuk apparatus 10 of the instant invention essentially comprises a plurality of spaced cylindrical handles 11 whose construction defines an upper terminal end, with each upper terminal end mounting a handle loop 13 defined as an integral portion of a polymeric cylindrical core 17 that is received within cylindrical bores formed coaxially aligned with each handle 11 directed through an upper terminal end thereof. The handle loops 13 mount a chain member 12 therebetween, wherein the chain member 12 is formed of a series of interlinked chain link loops 14 each formed of a flexible polymeric material of a geometric memory retentent material, wherein the loops 14 includes an aligned series of link gaps 15 to permit spreading of each frangible loop to thereby effect separation of the links relative to one another as well s allowing their reconnection to prevent inadvertent injury to a participant in use of the apparatus 10. The handles 11 are each formed of a cylindrical polymeric foam handle body 16 provide cushioning to prevent injury upon impact of the handle upon an individual.

Figure 5:
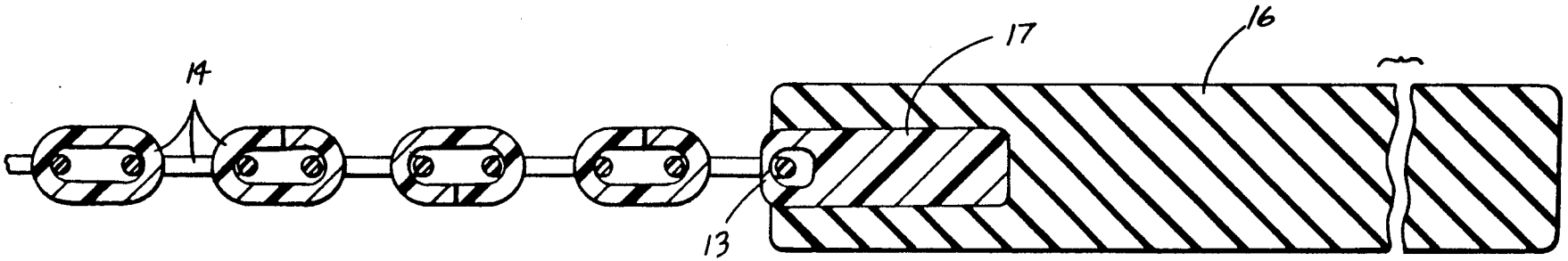
FIG. 5 is an orthographic side view of a modified toy nunchuk apparatus utilized by the instant invention.
Figure 4:
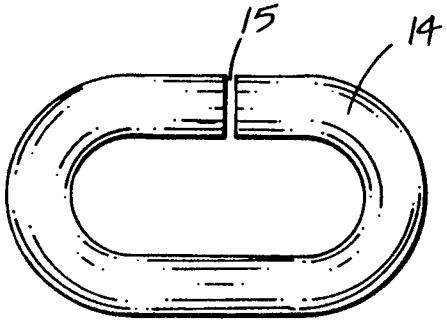
FIG. 4 is an orthographic side view of a typical chain link utilized by the instant invention.
Figure 5:
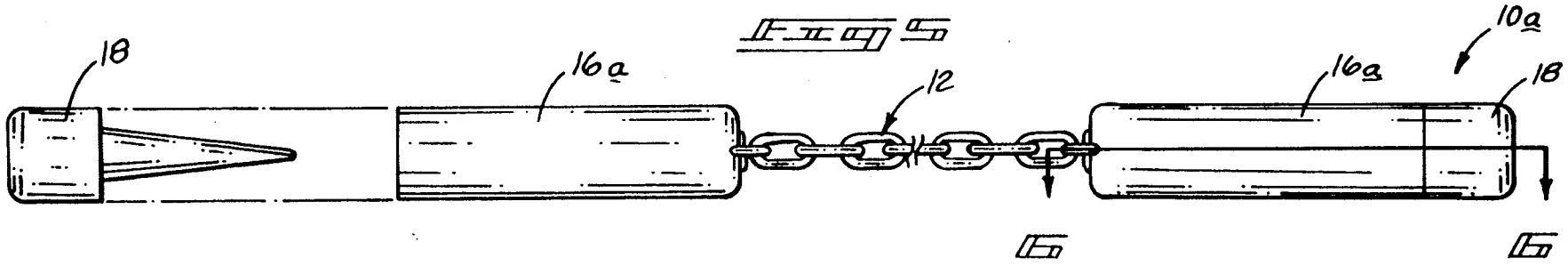
Figure 6:
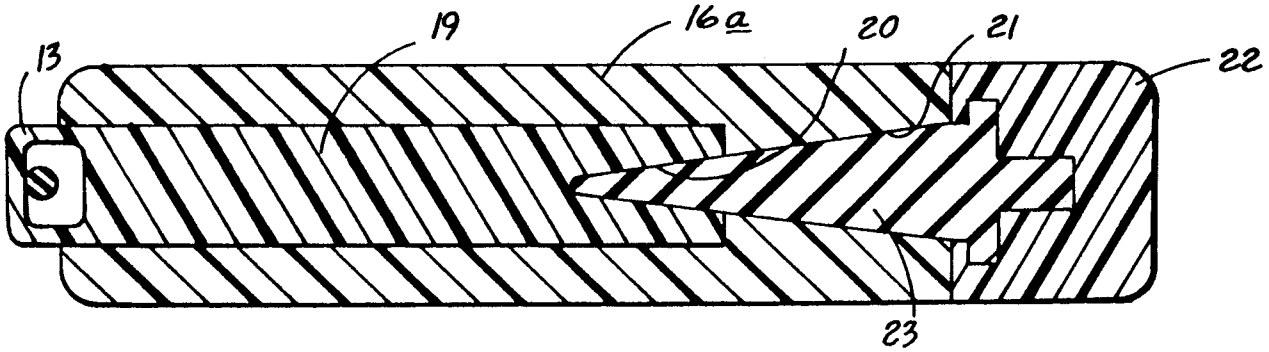
FIG. 6 is an orthographic view, taken on the lines 6—6 of FIG. 5 in the direction indicated by the arrows.

FIGS. 5 and 6 illustrate a modified apparatus 10*a* mounting a knife member 18 coaxially of each modified handle 16*a* to a rear terminal end of each cylindrical handle body 16*a* coextensively therewith. The knife members 18 each include a cylindrical knife handle 22 defined by a predetermined diameter substantially equal to the predetermined diameter of each modified handle 16*a* formed with a conical blade 23 coaxially aligned with the handle 22. The knife blade 23 is complementarily received within a conical bore 21 coaxially aligned with the handle body 16*a* and received within a receiving notch 20 within a rear terminal end of each modified cylindrical core 19 to receive the forward terminal end of each knife blade 23 in a reasonably secured manner, whereupon manual grasping of each knife handle 22 permits extraction of the associated knife member 18 from the modified handle body 16*a*.

Figure 7:
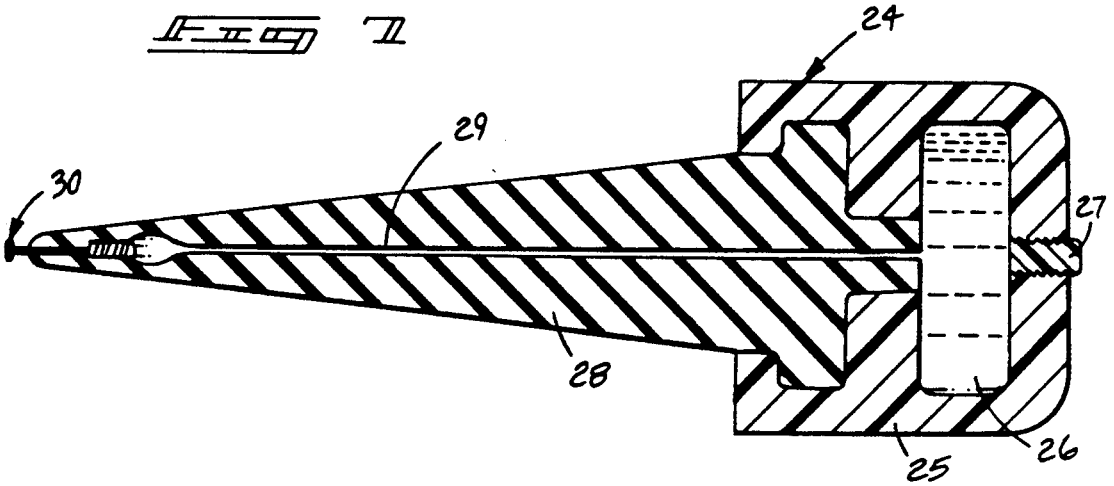
FIG. 7 is an orthographic cross-sectional illustration of a modified knife member utilized by the instant invention.
Figure 8B:
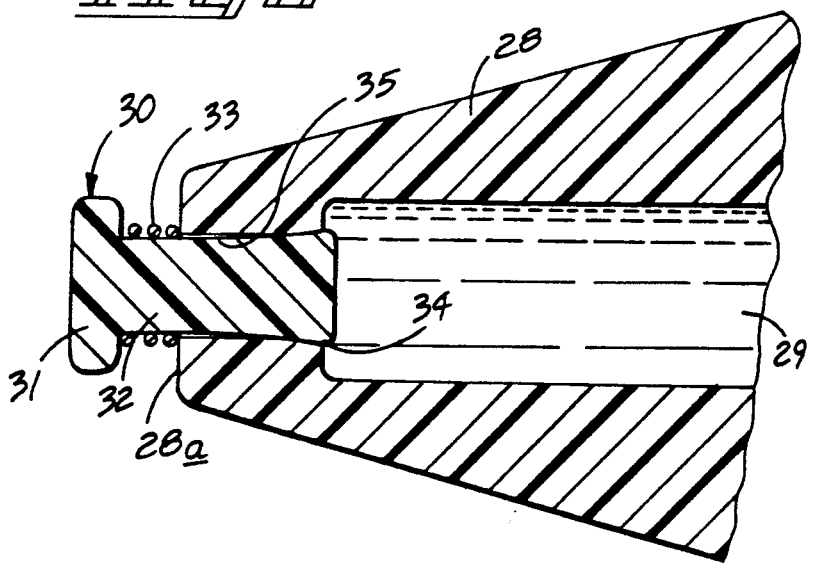
FIG. 8 is an orthographic enlarged illustration of the valve structure utilized by the knife member of the instant invention.

In a modified knife construction 24, as illustrated in FIGS. 7 and 8, the deformable cylindrical handle 25 is manually collapsible to effect pressurizing of a reservoir 26 formed within the cylindrical handle 25. A removable reservoir plug 27 is arranged to permit filling of the reservoir upon depletion of fluid therefrom. The conical knife blade 28 includes a planar forward end 28*a* orthogonally oriented relative to the axis of the knife blade 28 and the knife blade conduit 29 in fluid communication from the reservoir 26 directed outwardly therefrom in communication with a cylindrical stem conduit 35 that projects through to the knife blade forward end 28*a*. A knife blade valve 30 is reciprocatably mounted within the cylindrical stem conduit 35, wherein the knife blade valve includes a valve head 31 defined by a diameter greater than the stem conduit diameter, with a stem 32 reciprocatably mounted Within the stem conduit 35 and a spring 33 captured between the planar forward end 28*a* and the valve head 31. The valve stem 32 terminates in a stem conically flared interior end 34 that projects from the stem conduit 35 into the knife blade conduit 29, whereupon impacting of the valve head 31 upon a participant or surface, the valve head 31 is projected towards the planar forward end 28*a* removing the conically flared interior end 34 from the cylindrical stem conduit 35 permitting fluid from the reservoir 26 to be directed through the conduit 29 and through the stem conduit 35. Typically, such fluid is utilized with water soluble coloring to impart a red dye for example to simulate a successful knife attack and illustrate impacting of the knife upon an individual or surface.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A toy nunchuk apparatus, comprising, a plurality of spaced cylindrical handles, each cylindrical handle including an upper terminal end and a lower terminal end, with each cylindrical handle formed of a coaxially aligned configuration, with a chain member mounted to each upper terminal end of each cylindrical handle, and each cylindrical handle formed of a cylindrical polymeric foam handle body, including a blind cylindrical bore directed through the upper terminal end of each handle, and a polymeric cylindrical core removably and slidably mounted within each bore, and each core including a handle loop extending exteriorly of each upper terminal end of each cylindrical handle, and the chain member secured to and directed between each upper terminal end of each core, and the chain member is formed of a plurality of interconnected chain link loops, each chain link loop formed of a flexible polymeric memory retentent material, with each loop formed with a gap directed through each loop to permit separation of the loops relative to one another to prevent injury to an individual.

2. An apparatus as set forth in claim 1 wherein each handle body includes a knife member removably mounted within each lower terminal end of each handle body, each knife member includes a compressible and deformable cylindrical knife handle, each knife handle defined by a predetermined diameter, and each handle body defined by the predetermined diameter to coextensively position each cylindrical knife handle in coaxial alignment with each respective handle body.

3. An apparatus as set forth in claim 2 wherein each cylindrical handle includes a conical knife blade receivable within a complementarily configured conical cavity directed into the handle, and each cylindrical core includes a notch to secure a forward terminal end of each knife blade therewithin.

4. An apparatus as set forth in claim 3 wherein each knife blade includes a planar forward end, wherein each planar forward end is orthogonally oriented relative to each conical knife blade, and each knife handle includes a reservoir, and the reservoir includes a conduit directed from the reservoir through the planar forward end.

5. An apparatus as set forth in claim 4 wherein each conduit includes a cylindrical stem conduit, wherein each cylindrical stem conduit includes a valve member projecting interiorly of each planar forward end to permit selective fluid flow from each reservoir, and each deformable cylindrical knife handle permits pressurizing of the reservoir by manual clamping of each cylindrical knife handle during use.

6. An apparatus as set forth in claim 5 wherein the valve member includes a valve head defined by a valve head diameter greater than a stem conduit diameter defined by each stem conduit, and each valve head includes a valve stem slidably mounted within each stem conduit, and a conically flared interior end projecting from each valve stem into the conduit, and a spring captured between the valve head and the planar forward end to normally bias the flared interior end into sealing communication with the cylindrical stem conduit, whereupon impact of the valve head spaces the conically flared interior end from the cylindrical stem conduit permitting fluid flow from the reservoir through the cylindrical stem conduit.

* * * * *